US005600872A

United States Patent [19]

Artzt et al.

[11] Patent Number: 5,600,872

[45] Date of Patent: Feb. 11, 1997

[54] DOUBLE-BELT DRAW FRAME

[76] Inventors: Peter Artzt, Hugo-Wolf-Strasse 16, D-72 766 Reutlingen; Martin Conzelmann, Schwabstrasse 6/1, D-72 810 Gomaringen, both of Germany

[21] Appl. No.: 551,364

[22] Filed: Nov. 1, 1995

Related U.S. Application Data

[63] Continuation of Ser. No. 273,050, Jul. 8, 1994, abandoned.

[30] Foreign Application Priority Data

Jul. 14, 1993 [DE] Germany ..... 43 23 472.0

[51] Int. Cl.[6] ..... D01H 5/26; D01H 5/72

[52] U.S. Cl. ..... 19/244; 19/288; 19/150; 19/236

[58] Field of Search ..... 19/150, 236, 244, 19/246, 247, 256, 263, 286, 287

[56] References Cited

U.S. PATENT DOCUMENTS

| | | | |
|---|---|---|---|
| 2,659,936 | 11/1953 | Sandelin . | |
| 3,090,081 | 5/1963 | Klein | 19/288 |
| 3,122,794 | 3/1964 | Klein | 19/288 |
| 3,438,094 | 4/1969 | Field, Jr. | 19/288 |
| 4,290,170 | 9/1981 | Brookstein et al. | 19/244 X |
| 4,475,272 | 10/1984 | Wood | 19/150 X |
| 4,953,349 | 9/1990 | Fehrer | 19/236 X |

FOREIGN PATENT DOCUMENTS

| | | | |
|---|---|---|---|
| 294571 | 12/1988 | European Pat. Off. | 19/244 |
| 3927936A1 | 4/1990 | Germany . | |
| 2068421 | 8/1981 | United Kingdom | 19/244 |

*Primary Examiner*—John J. Calvert
*Attorney, Agent, or Firm*—Dority & Manning

[57] ABSTRACT

A process and device for bundling a fiber composite which has been drafted in a drafting device having a pair of output rollers and a pair of delivery rollers gathers together the fiber composite leaving the pair of output rollers in a fiber bundling zone. The fiber composite is conveyed through the fiber bundling zone and supported through the fiber bundling zone on one side by a conveying plane which moves in the direction of conveyance of the fiber composite. A suction air stream is drawn through the fiber bundling zone at substantially a right angle to the conveying direction of the fiber composite. The suction air stream causes the gathering together of the fiber composite in the bundling zone at a width substantially equal to a desired width of the fiber composite.

24 Claims, 4 Drawing Sheets

DOUBLE-BELT DRAW FRAME

This is a continuation of application Ser. No. 08/273,050, filed Jul. 8, 1994, which was abandoned upon the filing hereof.

BACKGROUND OF THE INVENTION

The instant invention relates to a double-belt draw frame for spinning plant machines with a fiber bundling zone which follows the pair of output rollers of the main drafting zone and is followed by the pair of delivery rollers. In this known type of draw frame (DE-A1-41 39 067) an additional pair of small belts running around the pair of output rollers is installed and guides the fiber composite emerging from the pair of output rollers directly into the pair of delivery rollers and whose small under-belts run over the lower rollers of the pair of output rollers as well as of the pair of delivery rollers. The upper roller of the pair of delivery rollers is provided with suction openings arranged in ring form. In this manner a greater number of fibers are to be bundled and compacted than in known draw frames, so that almost all the fibers are brought together and are compacted in the pair of delivery rollers, thus avoiding the formation of any so-called spinning triangle.

It has been shown that this device provides only limited satisfaction. Due to the fact that the pair of output rollers is surrounded on both side by a small belt, very high pressures must be applied in order to attain a perfect drafting nip point. This is in turn a disadvantage with small belts running at high speed because these belts are subjected to greater wear due to the high stress. Additionally, the fibers are also gathered together and bundled imperfectly. It was found that the double-belt guidance of the fiber sliver emerging from the pair of output rollers causes a gathering together and bundling to take place only directly in the input nip of the pair of delivery rollers through the suction zone of the upper roller of the pair of delivery rollers. Since the fibers are deflected very much in this gathering together, they follow this deflection only in part, and this results in incomplete bundling. Furthermore, no tension drafting is possible with the known device because the small under-belts extend over the output roller and the delivery roller.

It is known from DE-39 27 936 C1 that a completely drafted fiber sliver can be gathered together in a fiber bundling zone following drafting. At the output of the draw frame, a deflection path is provided for this and is formed by the lower output roller. In the area between the nip and the following pressure rollers which are also interacting with this output roller, the output roller is provided with a suction zone for the drafted fiber roving in the vicinity of which a blowing apparatus with a flow component perpendicular to the suction zone is installed. Fiber bundling is effected by this blown air stream while the suction zone only has the task of removing the blown air. It has been shown that the deflection as well as the blown air has a negative influence on the fibers during bundling, so that the desired, improved yarn values are not obtained.

OBJECTS AND SUMMARY OF INVENTION

It is a principal object of the instant invention to avoid the disadvantages of the state of the art and to improve the drafting as well as the bundling in such a manner that no spinning triangle is formed, but also in such a manner that the fibers do not become raveled or tangled as they are gathered together. Additional objects and advantages of the invention will be set forth in part in the following description, or will be obvious from the description, or may be learned through practice of the invention.

The objects are achieved through the characteristics of the invention. According to the invention, the suction air stream is only of approximately the width of the desired gathering together, so that a perpendicular flow acts upon the fiber composite (FB) for as long as the latter is wider than the suction air stream. Due to the fact that the fiber composite (FB) is subjected to only one suction air stream on an extensively plane conveying surface, the fibers can be gathered together in their parallel orientation without hindrance and without becoming disturbed in this process. It has been shown that a very good compaction of the fibers is achieved in this manner, so that no spinning triangle is formed at the output from the delivery roller pair and so that the yarn values, and also the spinning speed, are improved to a considerable degree.

During the gathering together of the fiber composite, the ratio of circumferential speed of the pair of output rollers and that of the pair of delivery rollers is adapted to the crimping of the fiber material. If the fiber material is under excessive tension, gathering together of the fibers is impaired. On the other hand, the tension necessary for the conveying speed must be present so that faultless conveying of the fiber composite is ensured.

The suction device according to the invention is best installed above the conveying plane, above the fiber sliver, so that suction is sucked from the space below the fiber composite. This results in good build-up and easy access to the draw frame, so that the small belts can be replaced without further assembly work.

The compacting apparatus is advantageously provided with a small perforated belt looped around the delivery roller which extends parallel to the fiber composite to a point immediately before the pair of output rollers. Through this arrangement the fiber composite emerging from the pair of output rollers is taken over immediately and is gathered together, but is at the same time also guided through the small belt. The small belt has perforations centered with respect to the running direction, these perforations determining the gathering together of the fiber composite into a fiber sliver. The size of the perforations is therefore advantageously selected as a function of the yarn number being spun. The adjustability of the small belt in its height or level relative to the pair of output rollers makes it possible to change the distance to the pair of output rollers. For this, a height-adjustable support is advantageously provided.

In order to avoid fiber from being caught between the small upper belt and the pressure roller near the spinning triangle, and thus also to improve the incorporation of the fibers, the tension of the small belt is adjustable in such a manner that the small belt becomes detached from the pressure roller near the output. Alternatively, this can also be achieved by providing a free space in the form of a groove on the delivery roller surrounded by the small belt, so that the fibers sucked in through the perforation cannot become caught between the roller surface and the small belt.

A draw frame for high-drafting of a fiber fleece on a spinning machine having a compacting part with a small perforated running belt is known from DE-AS 1 039 422. The small running belt is running at considerably slower speed than the separating roller preceding the small running belt, thus forming a fiber collection surface on which the individual fibers are collected into a roving by the separating roller. Compaction in the direction of conveying follows forming a completed roving from the pair of output rollers of the double-belt draw frame which is compacted perpendicularly to the conveying direction. The known device cannot be compared to the instant application, neither in its structure nor in its effect.

Further details of the invention are described through the figures.

DETAILED DESCRIPTION OF THE PREFERRED EMBODIMENTS

Figure 1:
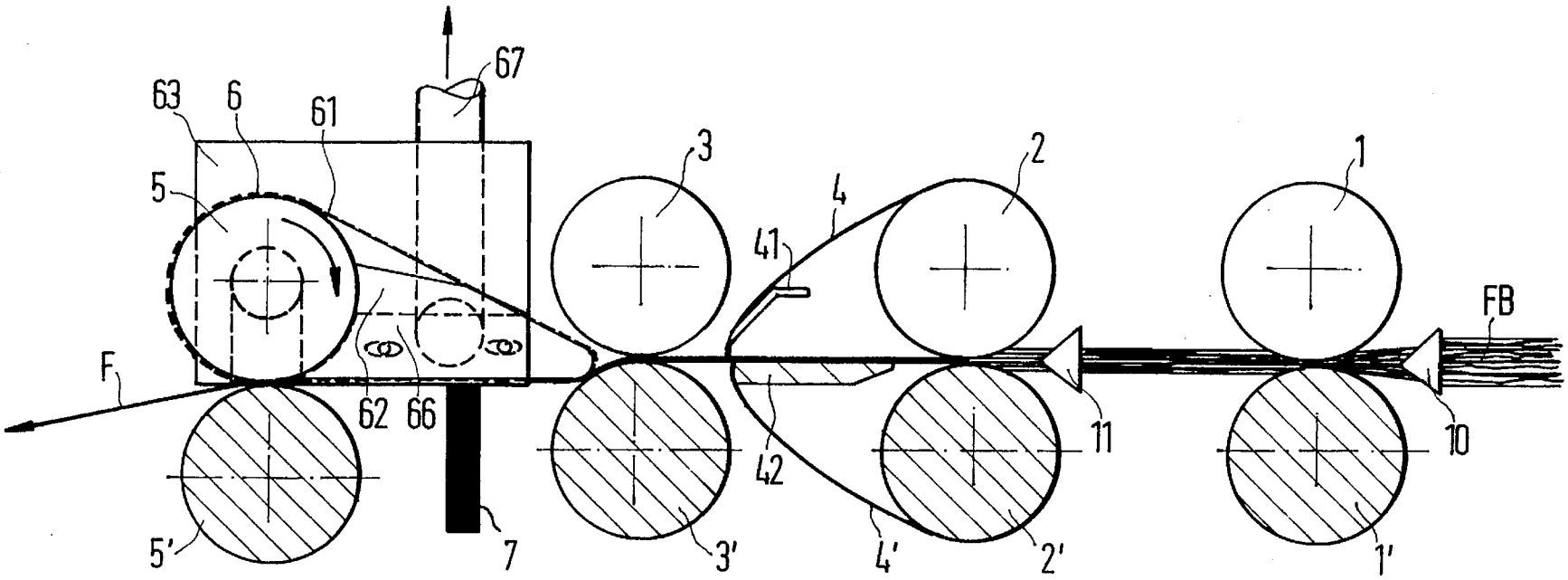
FIG. 1 shows the structure of the draw-frame according to the invention schematically, in cross-section.

Reference will now be made in detail to the presently preferred embodiments of the invention, one or more examples of which are illustrated in the drawings. Each example is provided by way of explanation of the invention, and not as a limitation of the invention. In fact, various modifications and variations can be made in the invention without departing from the scope or spirit of the invention.

The double-belt drafting device or draw frame consists in the usual manner of the first pair of rollers 1 and 1' which is fed the fiber sliver FB by a compactor or condenser 10. Between the first pair of rollers 1 and 1' and the second pair of rollers 2 and 2', the fiber composite is subjected to pre-drafting. Before entering the second pair of rollers 2, 2' the fiber sliver is gathered together by an additional compactor or condenser 11. Between the second pair of rollers 2, 2' and the pair of output rollers 3 and 3' the main drafting takes place in which the fiber sliver is guided through the small belts 4 and 4'. The small upper belt 4 is put under tension in the usual manner by a belt cage 41, while the small lower belt 4' runs over a rail 42 which serves at the same time to support the small upper belt. At the pair of output rollers 3, 3' the drafting of the fiber sliver is completed. Between the pair of output rollers 3, 3' and the pair of delivery rollers 5, 5' a fiber bundling zone follows in which the completely drafted fiber composite FB emerging from the pair of output rollers 3 and 3' is gathered together perpendicularly to the conveying direction, so that no spinning triangle is formed at the output from the pair of delivery rollers 5, 5' when the fiber composite is twisted together into yarn F.

Between the pair of output rollers 3, 3' and the pair of delivery rollers 5, 5' the fiber composite (FB) goes over an essentially plane path. The conveying plane is constituted by a small perforated belt 6 which supports the fiber composite (FB) on one side. Between the pair of output rollers 3, 3' and the pair of delivery rollers 5, 5' a suction device is provided from which a suction air stream is removed through the conveying plane formed by the small perforated belt 6 upon the fiber composite (FB) since air is sucked through the fiber composite (FB) from the space below the fiber composite (FB). The width of the suction air stream is determined by the perforation of the small belt. It is equal to the width of the fiber composite (FB) to be gathered together.

The small perforated belt 6 is taken around the delivery roller 5 and extends counter to the conveying direction into the nip of the pair of output rollers 3, 3'.

The small perforated belt 6 is guided by a known belt cage 62 which is designed as a suction device. The space enclosed by the small belt 6 and by the delivery roller 5 is closed laterally in order to render the suction effect going through the perforation 61 of the small belt 6 more effective. The belt cage 62 is advantageously made in the form of a housing which is connected via a pipe 67 to a central negative-pressure device.

Figure 5:
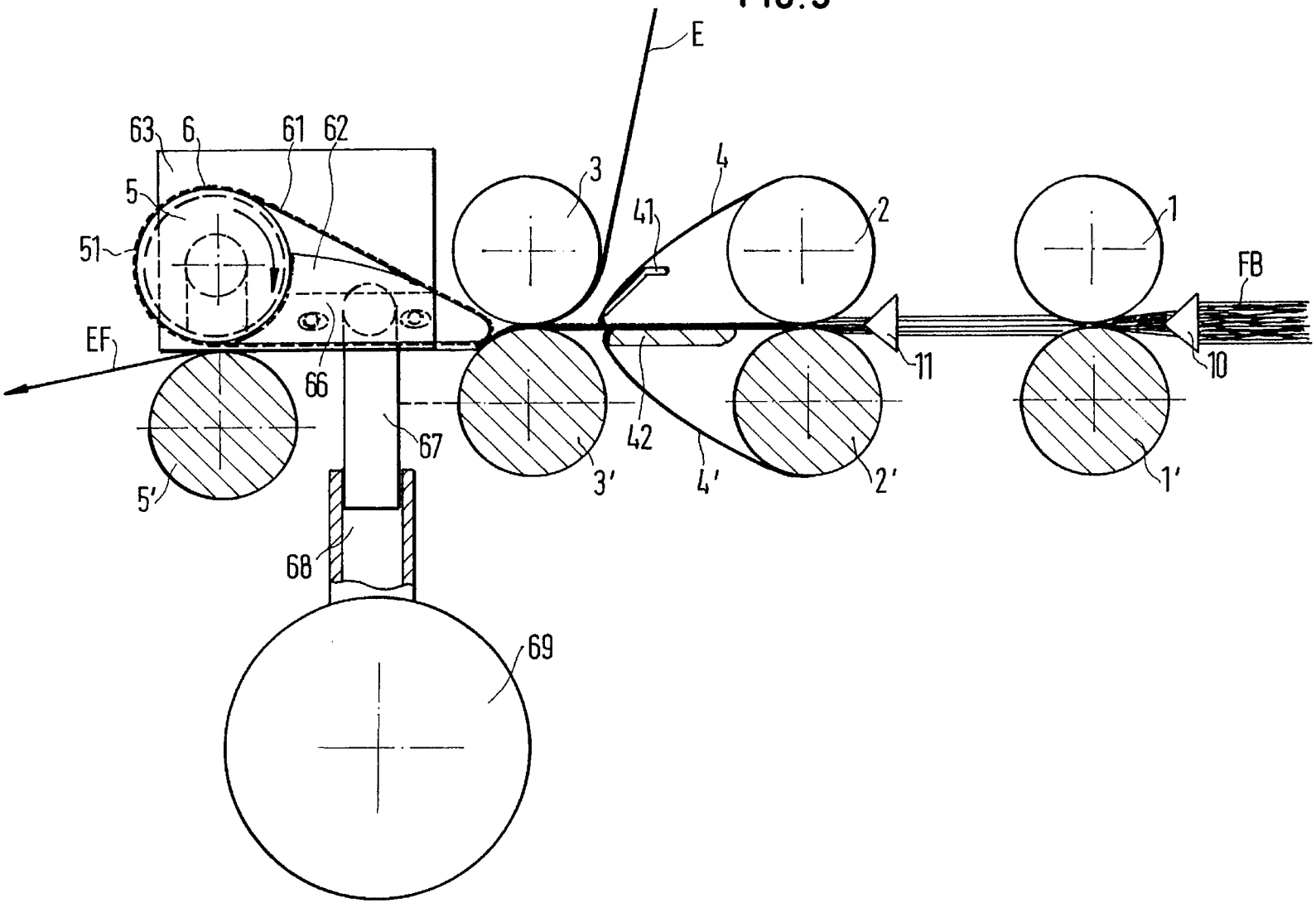
FIG. 5 shows another embodiment of the draw-frame according to the invention.

In the embodiment of FIG. 5, a central suction channel 69 is provided and is located below the lower cylinders 3' and 5'. This central suction channel 69 extends over all the draw frames, whereby a connection piece 68 is provided for each draw frame connected to the corresponding suction pipe 67. The connecting piece 68 and the suction pipe 67 are connected to each other by means of a plug-in coupling so that the suction pipe 67 can be separated from the connection piece 68 when the upper rollers 3, 5 are lifted. When the draw frame arm is lowered together with the upper rollers, the coupling to the connection piece 68 is then reestablished.

Figure 4:
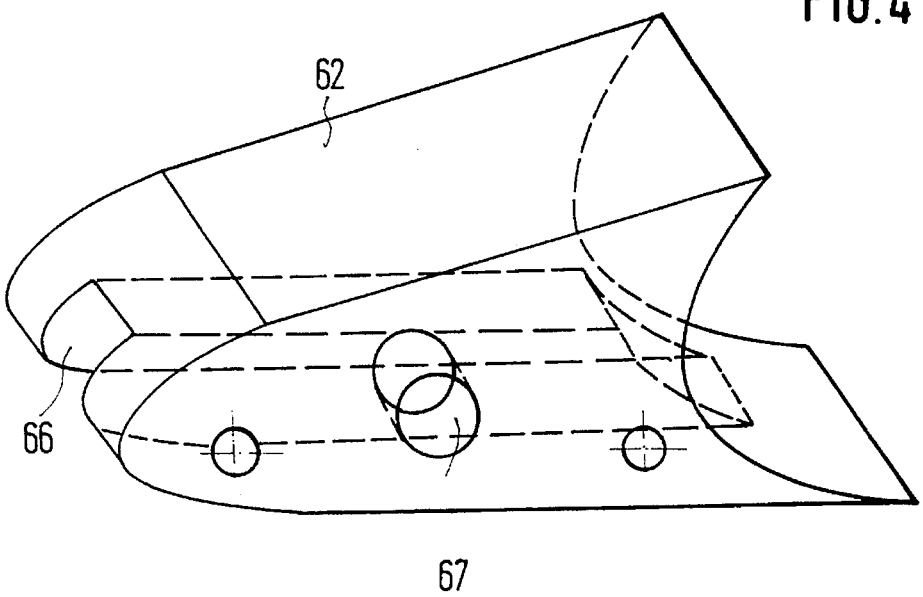
FIG. 4 shows further details in perspective view.

As can be seen from FIG. 4, the enclosed space is made in the form of a groove 66 which is closed off in the direction of the delivery roller 5 so that no suction effect may occur there. The groove 66 is, however, open at the forward end of the cage so that the deflection of the small belt 6 extending into the nip of the pair of output rollers 3, 3' is also subjected to suction. The width of the groove 66 is advantageously adapted to the widest possible width of the perforation 61 in the small belt so that faultless suction and guidance of the small belt 6 takes place at all times. To achieve better contact and thereby sealing of the groove 66, the underside of the belt cage 62 can also be slightly cambered in the longitudinal sense.

An adjustable support 7 is used to adjust the position of the small belt 6 in relation to the nip of the pair of output rollers 3, 3'. By changing the inclination of the small belt 6 together with the belt cage 62, the distance between the pair of output rollers 3, 3', and thereby the beginning of the compaction, is set. This adjustment of the inclination of the small belt 6 together with the belt cage 62 can also be effected by means of clips, such as is customary with draw frames, the clips being used for a given inclination. As can be seen from FIG. 1, the distance to the lower output roller 3' is reduced by lowering the belt cage 62. However, the distance must still be sufficient so that the emerging fiber composite (FB) may pass unhindered between the small belt 6 and the output roller 3'.

The functioning of the device is as follows: The fiber composite emerging from the pair of output rollers 3, 3' comes immediately into the range of the small belt 6. The suction air entering through the perforation 61 causes the fiber composite (FB) to be sucked onto the small belt 6. In this process, the suction air stream is drawn through the perforation and exerts corresponding forces upon the fibers of the fiber composite (FB). The width of the suction air stream is determined by the width of the perforation 61. The latter is selected so that the suction air stream has the width of the desired gathering together as the air passes through the perforation 61 of the small belt 6. The suction air stream acts at a perpendicular to the perforation 61 which also has a transversal effect. As a result, the fiber composite (FB) is gathered together at a right angle to the conveying direction. The gathering together starts after emergence from the pair of output rollers and can continue unhindered up to the entry into the nip of the pair of delivery rollers 5, 5' at least over the length of the suction air stream. This gives the fibers sufficient time to become concentrated to the width indicated by the perforation 61 during their transportation in this fiber bundling zone.

The groove 66 which is open towards the nip of the pair of output rollers 3, 3' is also subjected to suction by the device 62 in this zone. This has the advantage that the fibers emerging from the nip of the pair of output rollers 3, 3' are aspired immediately and are guided onto the small belt 6. Furthermore, this suction prevents laps from forming at the output roller 3. Depending on how strongly the fiber material is crimped, the ratio between the circumferential speeds of the pair of output rollers 3, 3' and the pair of delivery rollers 5, 5' can be adapted so that less run-on or after-running is produced. This makes it possible to avoid excessive tension in the case of heavily crimped fibers which would detrimentally affect the gathering together and ensures that sufficient tension is present for the conveying speed in order to provide perfect conveying of the fiber composite (FB).

The length of the fiber bundling zone is determined by the distance between the pair of output rollers 3, 3' and the pair of delivery rollers 5, 5'. It is approximately equal to the distance between the roller pairs 2, 2' and 3, 3' in the main drafting zone. As a rule, a nip distance of approximately 1½ times the fiber length is sufficient here. The length of the suction air stream is shorter. To decrease air consumption, it suffices if the suction air stream acts over one half the distance at the most. A greater length does not produce any better gathering together in the fiber bundling zone. The pair of output rollers 3, 3' and the pair of delivery rollers 5, 5' run at approximately the same circumferential speed, or with a slight tension or draft which depends on the fiber material and on the conveying speed.

The small belts 6 can of course also loop around the lower delivery roller 5' so that the fiber composite (FB) comes to lie on the small belt 6. The arrangement above the conveying plane, with the looping around the upper delivery roller 5, has however the advantage that the small belt 6 can be replaced easily since the upper rollers 5 are over-mounted on the weighting arm of the draw frame. The space below the small belt 6 or on the opposite side of the conveying plane is free, so that the fibers which are conveyed only on one side can move freely and can be gathered together unhindered at a right angle to the conveying direction by the air stream.

Because of the air stream it happens that fiber ends are sucked through the perforation 61 and are then caught between the small belt 6 and the upper roller 5. This results in bothersome disturbances because these fibers are not able to follow the direction of the fiber composite (FB) twisted together into yarn F and are pulled out of the yarn. Appropriate adjustment of the tension of the small belt 6 loosens the belt on the output side and lifts the belt from the surface of the delivery roller 5 (indicated in FIG. 1). In this way the fiber ends sucked through the perforation 61 are released and can follow the direction of the fiber composite twisted together into yarn F.

To be able to carry out the desired adjustment, the belt cage 62 made in the form of a suction device, is attached to a support 63 by way of oblong holes 65. The support 63 is mounted on the axle of the pair of delivery roller 5 and is provided with the suction pipe 67 through which the belt cage 62 is connected to a negative-pressure device.

The lift-off effect of the small belt is assisted through appropriate selection of the material of which the small belt is made. The small belt 6 is therefore advantageously made of a material with greater elasticity than is normally the case in small belts used in draw frames. Such greater elasticity can be achieved for instance if the small belts used in the fiber amalgamating or bundling zone do not have any fabric insert.

The release of the fibers can also be achieved in another manner, e.g. if the delivery roller 5 is provided with a free space in the form of a ring-shaped groove 51 in the area of the perforation of the small belt (FIG. 5). This also prevents fibers sucked in between the small belt 6 and the upper roller 5 from becoming caught and producing interference in the formation of yarn. In this embodiment conventional belts with a fabric insert can be used. Even at high delivery speeds this leads to a considerable improvement of yarn values.

The lift-off effect described above can also be achieved independently of material selection for the small belt 6, e.g. by braking the small belt 6 after the nip of the pair of delivery rollers 6, 6' in the returning trunk. This can be achieved easily by applying a leaf spring or similar device (not shown).

The distance over which the fiber composite (FB) is gathered together in the fiber bundling zone at a right angle to the conveying direction depends to a great extent on the size of the perforation 61. The small belt 6 is therefore provided with perforations 61 which are centered in the direction of movement, through which the suction air stream passes. If a thicker yarn number is being spun, the fiber composite to be gathered together is wider. The size of the perforation 61 is therefore selected somewhat greater at a right angle to the conveying direction than with fine yarns, where it is important to gather the fiber composite together more tightly in order to avoid the spinning triangle. In the conveying direction, the distance between the perforations 61 and their size must be selected so fiber ends are prevented as much as possible from being sucked in. For this, it has been shown to be advantageous to make the distance between the perforations 61 in conveying direction approximately twice the diameter of the perforations 61. In addition, compaction can also be influenced by the negative pressure. Depending on the setting of the negative pressure, a desired compaction can be achieved, so that in the extreme case the negative pressure can be selected so that it is possible to work with or without the spinning triangle. In this manner, the yarn characteristics such as hairiness, etc. can be influenced.

The process according to the invention is also especially suitable for the production of core yarns. For this, and endless yarn E, e.g. a yarn filament, is introduced directly into the pair of output rollers 3, 3' of the draw frame. This yarn E runs together with the fiber composite (FB) through the fiber bundling zone between the pair of output rollers 3, 3' and the pair of delivery rollers 5, 5' in which the fibers are already applied to the endless yarn by being gathered together and are then twisted into a core yarn (EF) as they leave the pair of delivery rollers 5, 5' (FIG. 5).

Figure 2:
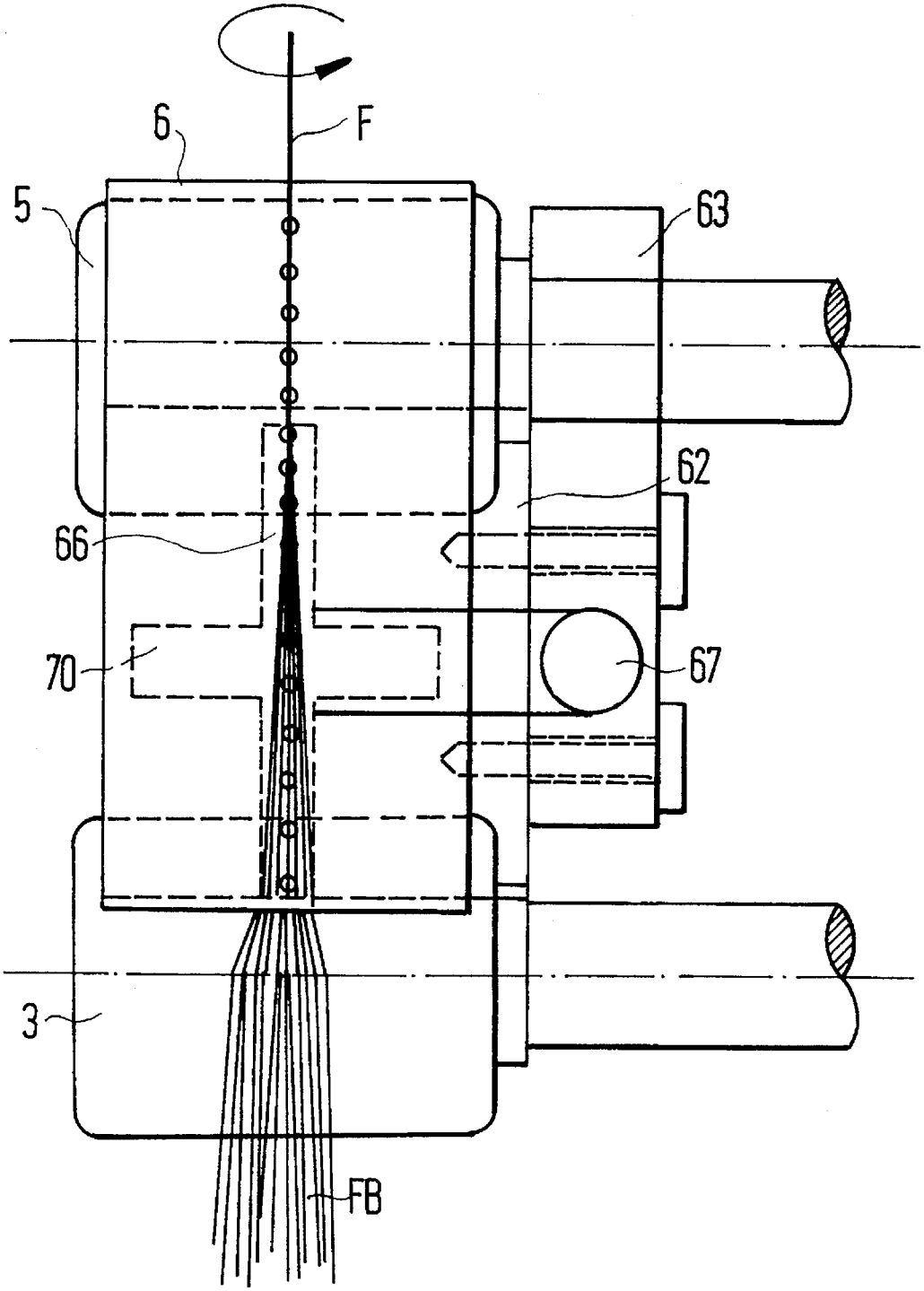
FIG. 2 shows a top view of the conveying plane as see from below the draw frame cylinder.
Figure 3:
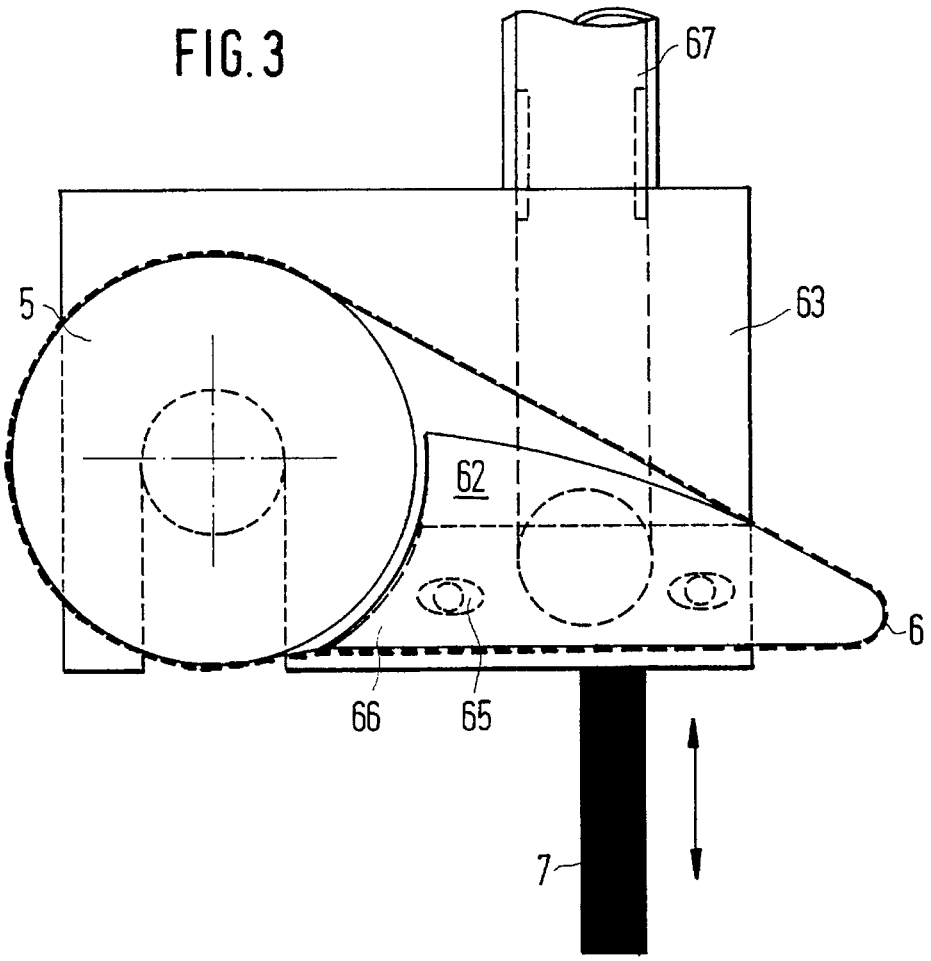
FIG. 3 shows the compacting unit in detail.

It may occur that fiber dust and other impurities are deposited on the inside of the small belt 6. In order to produce automatic cleaning of the small belt 6, a cleaning opening 70 is provided on the underside of the belt cage 62 (FIG. 2). This cleaning opening 70 extends at a right angle toward the suction groove 66 of the width of the small belt 6. At its two ends, the cleaning opening 70 is closed so that the suction effect only acts upon the inside of the small belt 6.

The gathering together of the fiber composite (FB) according to the invention following drafting and the avoidance of a spinning triangle makes it possible to achieve considerably higher substance utilization in forming yarns. To achieve the same strength as in spinning with a spinning triangle, the twist can be reduced considerably. This means an increase of productivity by approximately 20% to 30% per spindle or spinning position.

It will be apparent to those skilled in the art that various modifications and variations can be made in the present invention. For example, features of one embodiment can be used on another embodiment to yield a still further embodiment. It is intended that the present invention cover such modifications and variations as come within the scope of the appended claims and their equivalents.

We claim:

1. A process for bundling a fiber composite which has been drafted in a drafting device having a pair of output rollers and a pair of delivery rollers, said process comprising gathering together the fiber composite leaving the pair of output rollers of the drafting device in a fiber bundling zone; conveying the fiber composite through the fiber bundling zone and supporting the fiber composite through the fiber bundling zone on one side by a substantially flat conveying belt which moves in the direction of conveyance of the fiber composite between the output rollers and the delivery rollers; drawing a suction air stream through the conveying belt over at least a portion of the fiber bundling zone, the suction air stream drawing the fiber composite against the conveying belt over the width of the suction air stream defined through the belt causing the gathering together of the fiber composite; and drawing the suction air stream through the conveying belt to act on the fiber composite supported thereby at a width substantially equal to a desired width of the bundled fiber composite.

2. The process as in claim 1, further comprising adjusting the circumferential speed ratio between the output and delivery rollers as a function of crimp of the fiber composite material.

3. The process as in claim 1, wherein the speed of the conveying belt is dependent upon the speed of the delivery rollers.

4. The process as in claim 1, further comprising varying the degree of bundling of the fiber composite by varying the intensity of the suction air stream.

5. The process as in claim 1, further comprising introducing a yarn filament into the fiber composite for production of a core yarn, the yarn filament introduced directly into the output rollers and covering the distance between the output rollers and delivery rollers.

6. A drafting device having a main drafting zone with a pair of output rollers and a pair of delivery rollers, said drafting device further comprising:

a fiber bundling zone defined between said output rollers and said delivery rollers;

a pneumatic condensation apparatus provided within said fiber bundling zone, said condensation apparatus comprising a conveying plane for a fiber composite leaving said output rollers, said conveying plane further defined by a perforated belt; and said condensation apparatus further comprising a suction device extending along one side of said perforated belt opposite said fiber composite, said suction device configured to draw a suction air stream through said perforated belt and said fiber composite for bundling together said fiber composite.

7. The drafting device as in claim 6, wherein said suction device is disposed above said conveying plane in the area of the upper rollers of said output and delivery rollers, said suction device drawing air from the space below said fiber composite.

8. The drafting device as in claim 6, wherein said perforated belt is looped around the upper roll of said delivery rollers and extends parallel to said fiber composite to substantially immediately in front of said output rollers.

9. The drafting device as in claim 8, wherein said perforated belt comprises perforations which are centered with respect to the length of said belt and through which said suction air stream is effective.

10. The drafting device as in claim 9, wherein said perforations comprise a size which is dependent upon the yarn number of said fiber composite, so that larger sized perforation are provided with thicker yarn number.

11. The drafting device as in claim 6, wherein said perforated belt is comprised of a elastic material without any fabric insert.

12. The drafting device as in claim 6, wherein the level of said perforated belt with respect to said output rollers is adjustable.

13. The drafting device as in claim 12, further comprising an adjustable support configured with said perforated belt for changing the level of said belt.

14. The drafting device as in claim 6, wherein said suction device defines a zone between said output rollers and said delivery rollers which is closed off laterally and is connected to a negative pressure source.

15. The drafting device as in claim 14, wherein said suction device comprises a belt cage between said output rollers and said delivery rollers.

16. The drafting device as in claim 15, wherein said belt cage comprises a groove defined therethrough through which said perforated belt runs, said groove further comprises a suction pipe inlet in communication with said negative pressure source.

17. The drafting device as in claim 16, wherein said belt cage further comprises a cleaning opening defined therein in communication with a negative pressure source for cleaning said perforated belt.

18. The drafting device as in claim 17, wherein said cleaning opening extends substantially perpendicular to said groove over the width of said belt.

19. The drafting device as in claim 6, wherein said suction air stream drawn by said suction device is adjustable in strength.

20. The drafting device as in claim 6, wherein said suction device is essentially closed off from said delivery rollers and is open to said output rollers across the nip thereof for allowing said fiber composite to be conveyed thereto.

21. The drafting device as in claim 8, wherein said perforated belt comprises an adjustable tension so that said belt can be loosened from said delivery roller.

22. The drafting device as in claim 15, wherein said belt cage is attached to a support and is adjustable in relation to said delivery rollers.

23. The drafting device as in claim 8, wherein said delivery roller around which said perforated belt is looped comprises a circumferential free space defined therearound in the area of said perforated belt.

24. The drafting device as in claim 6, wherein said drafting device comprises a suction channel fixedly installed therein in the area of the lower rollers of said output and delivery rollers, said suction device being movable with the upper rollers of said output and delivery rollers and connected to said suction channel with a coupling.

* * * * *